United States Patent [19]

Natland

[11] 4,142,168

[45] Feb. 27, 1979

[54] SWITCH CONSTRUCTION

[76] Inventor: James P. Natland, 333 Weymouth Pl., Laguna Beach, Calif. 92651

[21] Appl. No.: 802,720

[22] Filed: Jun. 2, 1977

[51] Int. Cl.[2] ..... H01H 36/00

[52] U.S. Cl. ..... 335/207; 340/644; 200/314

[58] Field of Search ..... 335/207, 206, 205, 17, 335/92, 306, 140; 200/67 F; 340/378 MW, 252 R

[56] References Cited

U.S. PATENT DOCUMENTS

| | | | |
|---|---|---|---|
| 3,133,173 | 5/1964 | Vriens | 335/207 |
| 3,651,438 | 3/1972 | Hayashi | 335/207 |
| 3,753,179 | 8/1973 | Straub | 335/207 |
| 4,015,226 | 3/1977 | Stomma et al. | 335/207 |

*Primary Examiner*—Harold Broome
*Attorney, Agent, or Firm*—Lyon & Lyon

[57] ABSTRACT

Operation of a push button, operates an advancement mechanism to index one of a plurality of magnets adjacent to a fixed polarity magnet coupled to electrical switch contacts to thereby actuate the same. Such plurality of magnets are alternately south and north pole magnets for successively attracting and repelling the fixed polarity magnet on the switch plate upon successive operations of the push button. Indicating lamps may be provided on the push button, the lamps being protected and accessible beneath a transparent lid pivoted on the push button.

7 Claims, 5 Drawing Figures

SWITCH CONSTRUCTION

BACKGROUND OF THE INVENTION

The present invention relates to a switch construction involving the use of permanent magnets to alternately close and open an electrical switch upon repeated depression of a push button.

SUMMARY OF THE INVENTION

An object of the present invention is to provide a new switch which is relatively simple in construction, inexpensive to manufacture and foolproof in achieving its purposes.

Another object of the present invention is to provide a novel actuating mechanism for a switch using a plurality of magnets of different polarity cooperating with at least one other magnet to achieve movement of the switch contacts.

Another object of the present invention is to provide a switch actuated by operation of a pawl ratchet or another similar advancement mechanism of conventional design which in turn is operated by a push button.

These objects and advantages and the various features of the present invention will become more readily apparent upon reveiwing the ensuing detailed description taken in conjunction with the accompanying drawings.

DETAILED DESCRIPTION

Figure 1:
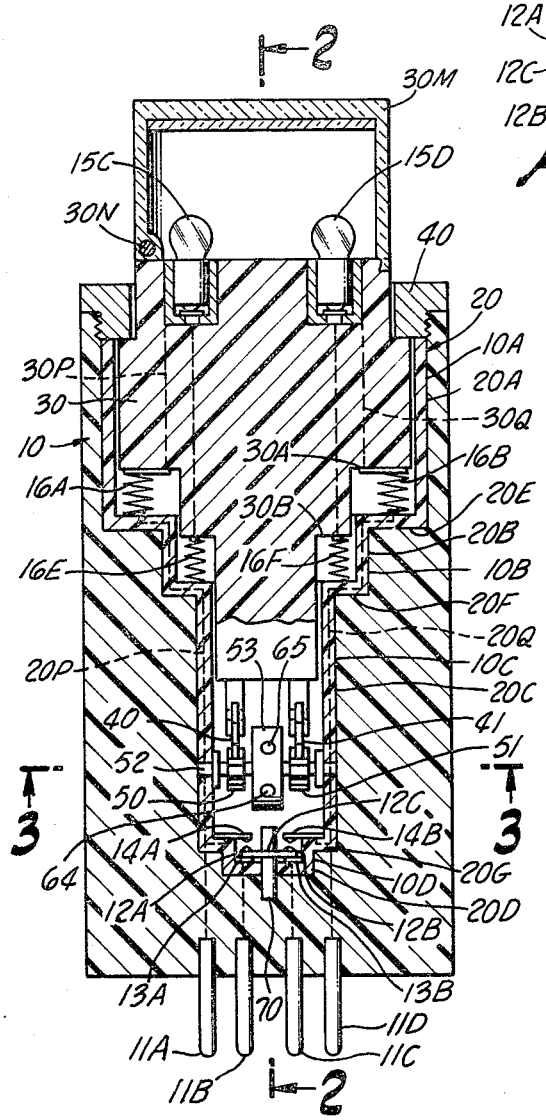
FIG. 1 is an irregular sectional view of the apparatus embodying the present invention.

The switch apparatus illustrated in the drawings includes a housing body 10 of insulating material in which a total of eight contact pins or terminals 11A–11H are embedded, the pins 11A–11H extending from body 10 for attachment to a connecting female socket (not shown) or as electrical terminals of other types well known in the art.

The body 10 of insulating material is generally cylindrical and is internally bored to provide four internal bores 10A, 10B, 10C, 10D of decreasing diameter so as to snugly receive the liner 20 of insulating material which is formed to have corresponding cylindrical portions 20A, 20B, 20C and 20D with interconnecting portions 20E, 20F and 20G.

Figure 2:
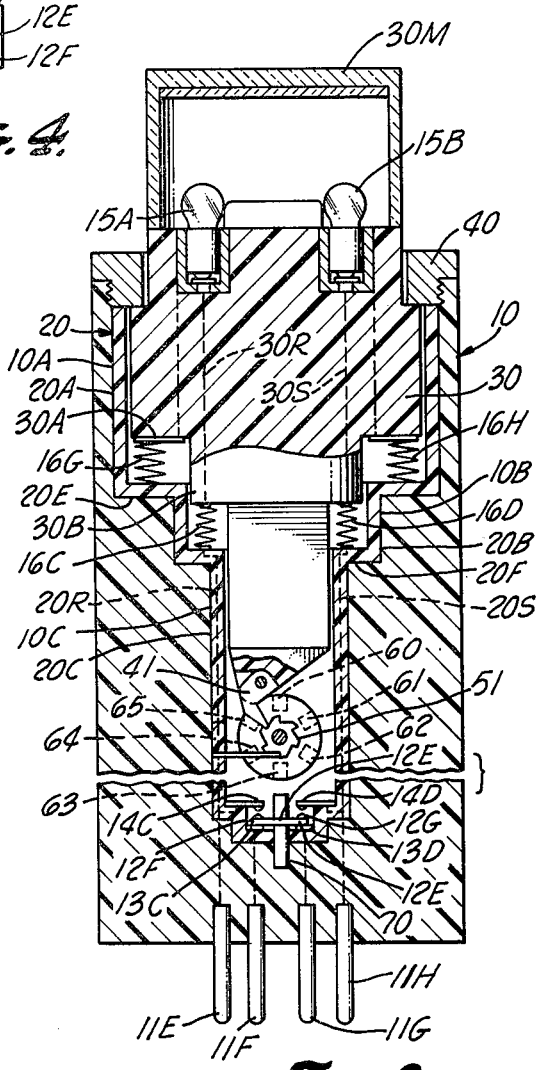
FIGS. 2 and 3 are sectional views taken substantially on corresponding lines 2—2 and 3—3 in FIG. 1, the lower part of housing body 10 in FIG. 2 is displaced 90 degrees for purposes of illustrating a total of eight pins 11A–11H.
Figure 3:
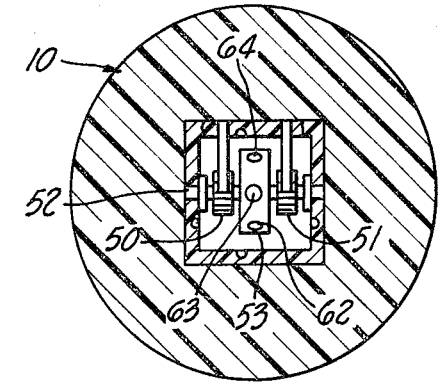

A push-button element 30 of insulating material is slidably mounted in the sleeve liner 20. Element 30 is urged upwardly in FIG. 1 against the retainer cap 40 which is threaded in the body 10 by a series of coil compression springs 16A, 16B, 16C, 16D which serve also as electrical conductors as described later as well as by the additional coil compression springs 16E, 16F, 16G, 16H; the element 30 being formed as shown in FIGS. 1 and 2 to provide shouldered portions 30A and 30B. The springs 16A, 16B, 16G, 16H are disposed between shouldered portions 30A and shouldered portion 20E and the springs 16E, 16F, 16C, 16D are disposed between shouldered portions 30B, 20F. Springs 16A–16B could be a single, larger diameter spring, as could the other springs 16.

Push-button element 30 has a pair of pivotally mounted pawl elements 40, 41 engageable in conventional fashion with a corresponding pair of ratchet wheels 50, 51.

Ratchet wheels 50, 51 are on a shaft 52 which is rotatable on the sleeve liner portion 20C. Also mounted on shaft 52 and rotatable therewith is a disc 53 that carries six equally circumferentially spaced permanent magnets 60, 61, 62, 63, 64, 65. These magnets 60–65 are alternately of different magnetic polarity, i.e., the first has a projecting north pole, the second has a projecting south pole, the third has a projecting north pole, etc.

These six magnets 60–65 are in turn successively moved into magnetic cooperation with a permanent magnet 70 upon successive depressions of such push-button element 30 that result in successive stepping of the shaft 52 through sixty degrees caused by successive operation of the pawl ratchet mechanism 40, 41, 50, 51.

Figure 4:
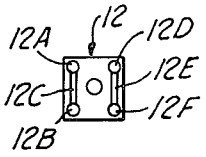
FIG. 4 illustrates a part of the switch included in the apparatus of FIG. 1.

The permanent magnet 70 is affixed to switch plate 12 so that the polarity of magnet 70 is permanently set, be it north or south pole upward as desired. The switch plate 12 which may be of insulating material with electrical contacts mounted on opposite sides thereof with different ones of such contacts being interconnected by conducting strips as exemplified in FIG. 4 where there is a series of contacts 12A, 12B and 12D, 12F on one side of plate 12, the metal contacts 12A, 12B may be interconnected by metal strip 12C and the contacts 12D, 12F may be interconnected by metal strip 12E. The contacts 12A, 12B, 12D, 12F may of course be interconnected in a different pattern than that shown in FIG. 4 for achieving a different switching function than that illustrated in FIG. 5. Also as indicated above the underside of switch plate 12 may have metal contacts thereon interconnected in any desired pattern to interconnect different ones of the pins 11B, 11C, 11F, 11G when such plate 12 is in its lowermost position in FIG. 2.

Optionally the switch may be provided with four lamp bulbs 15A, 15B, 15C and 15D screwed into sockets secured in the push-button element 30, these bulbs normally being covered by a transparent cover 30M which is hinged on the element 30 using pivot pin 30N.

Figure 5:
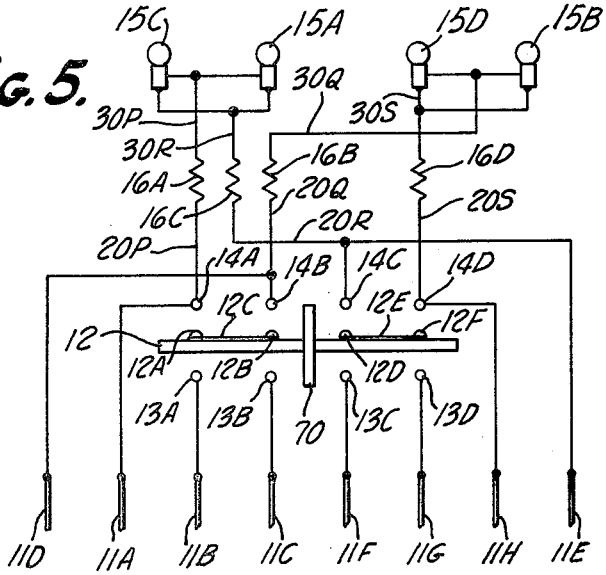
FIG. 5 is a schematic of the electrical connections shown in FIGS. 1 through 4.

It will be seen that the lamps 15A–15D are connected as seen in the schematic drawing FIG. 5 and such connections are physically made using springs 16A, 16B, 16C, 16D in FIG. 5.

The switch plate 12 has its contacts 12A, 12B, 12C, 12D engageable with the stationary contacts 14A, 14B, 14C, 14D mounted on the sleeve liner 20 with connections between the lamps 15A–15D and pins 11A–11H as illustrated in FIG. 5, such connections being made using the abovementioned springs 16A–16D and wires embedded in or placed in channels in the sleeve liner 20 as exemplified by the wire connectors 20P, 20Q, 20R, 20S in the sleeve liner 20 and wire connectors 30P, 30Q, 30R, 30S in the push-button element 30.

Although the foregoing description and the preceding drawings describe a ratchet and pawl mechanism, it is contemplated that other similar advancement mechanisms and/or escapements might be employed. The requirement is for a mechanism which will alternately position north and south magnet poles properly indexed with respect to fixed polarity magnet 70. It is also contemplated that the number of movable magnets 60–65 may be varied, taking into account cost of manufacture, reliability, ease of operation, efficacy, etc.

Operation of the switching apparatus is accomplished by pressing the lid 30M on the push-button element 30 sufficiently to cause operation of the advancement mechanism 40, 41, 50, 51 to rotate the magnet wheel one sixth of a revolution to thereby place one of the six magnets 60–65 in juxtaposition with the magnet 70 on switch plate 12. If such magnet is polarized to have an upper north pole, when a south pole magnet on wheel 53 is indexed adjacent magnet 70 there is a magnetic attraction between the two magnets to cause the switch plate 12 to raise sufficiently so that the electrical switch contacts on plate 12 engage the stationary switch contacts 14A–14D on the sleeve liner 20. The push button may then be released and its next depression causes the next adjacent magnet on wheel 53 which is then a magnet with a north pole to be indexed adjacent to the north pole magnet on plate 12 in which case there is a magnetic repulsion and the switch plate then contacts the lower stationary contacts 13A–13D as illustrated in FIGS. 1 and 2. This operation may be repeated resulting in alternate closing and opening of the composite switch.

I claim:

1. An electrical switch comprising:

a plurality of stationary switch contacts and a movable switch element associated therewith, a first permanent magnet affixed to said switch element for moving said element relative to said switch contacts;

a plurality of second magnets, support means for carrying said second magnets whereby the poles thereof are positioned in alternating, spaced relationship;

indexing means cooperating with said support means for indexing successively alternating poles of said second magnets adjacent a pole of said first magnet to selectively attract and repel said first magnet to actuate said switch element.

2. A switch as set forth in claim 1 in which said support means comprises a rotatable wheel, said second magnets being mounted about the periphery of said wheel at equally spaced intervals, the axes of said magnets being aligned along radii of said wheel, alternate north and south poles of said magnets being positioned radially outwardly.

3. A switch as set forth in claim 2 wherein said indexing means comprises a ratchet and pawl assembly.

4. A switch as set forth in claim 2 in which said rotatable wheel is rotatable with a shaft on which a ratchet is mounted, and said indexing means includes a pawl engageable with said ratchet means for moving successive ones of said second magnets into indexed magnetic cooperation with said first magnet on said switch element.

5. A switch as set forth in claim 3 including a housing in which said shaft and said ratchet are rotatably mounted, a push-button element slidably mounted in said housing and carrying said pawl, and spring means acting between said push-button element and said housing urging said element to a predetermined at rest position.

6. A switch as set forth in claim 5 in which said housing includes a liner on which said shaft is rotatably mounted and also on which said stationary switch contacts are mounted, an indicating lamp mounted on said push-button element, an electrical current path to said lamp, said current path including a conducting wire in said lining, at least one of said spring means and a conductor wire in said push-button element.

7. A switch as set forth in claim 6 in which a transparent lid is mounted on said push-button element and covers said lamp.

* * * * *